US006912875B2

(12) United States Patent
Fehrenbacher

(10) Patent No.: US 6,912,875 B2
(45) Date of Patent: Jul. 5, 2005

(54) SHIPPING UNIT MADE UP OF MACHINE ELEMENTS

(75) Inventor: Eckhard Fehrenbacher, Bondorf (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/860,722

(22) Filed: Jun. 4, 2004

(65) Prior Publication Data

US 2004/0244429 A1 Dec. 9, 2004

(30) Foreign Application Priority Data

Jun. 6, 2003 (DE) ..... 103 25 671

(51) Int. Cl.[7] ..... D04B 35/02
(52) U.S. Cl. ..... 66/1 R; 66/116
(58) Field of Search ..... 66/1 R, 116–124, 66/90, 91, 104

(56) References Cited

U.S. PATENT DOCUMENTS 5,966,969 A * 10/1999 Mista ..... 66/206
6,155,080 A * 12/2000 Yamaguchi et al. ..... 66/1 R
6,484,541 B1 * 11/2002 Haag ..... 66/104

FOREIGN PATENT DOCUMENTS

| | | |
|---|---|---|
| AT | 85802 | 10/1921 |
| DE | 1 103 233 | 3/1961 |
| DE | 94 16 552.1 | 3/1995 |
| DE | 295 12 594 U1 | 9/1995 |
| DE | 296 02 636 U1 | 7/1996 |
| DE | 101 46 921 A1 | 8/2002 |
| DE | 101 48 196 C1 | 4/2003 |

* cited by examiner

*Primary Examiner*—Danny Worrell
(74) *Attorney, Agent, or Firm*—Fitch, Even, Tabin & Flannery; Norman N. Kunitz; George H. Spencer

(57) ABSTRACT

A plurality of machine elements, such as needles (2), are combined into a shipping unit (1) by material connections, such as an adhesive bond, and this shipping unit can be easily transported and stored. The machine elements can easily be separated by hand or with simple tools and inserted individually, for instance into the needle tracks of a knitting machine.

24 Claims, 4 Drawing Sheets

1
2
3
4
5
12
15
16
17
18
19
21
22
23
26

SHIPPING UNIT MADE UP OF MACHINE ELEMENTS

CROSS REFERENCE TO RELATED APPLICATION

This application claims the priority of German Patent Application No. 103 25 671.1, filed on Jun. 6, 2003, the subject matter of which, in its entirety, is incorporated herein by referece.

1. Field of the Invention

The invention relates to an arrangement of machine elements, in particular needles for loop-forming machines, in the form of a packet.

2. Background of the Invention

Knitting machines have knitting systems which include multiple parts, so-called system parts, in particular needles. Each knitting machine has a large of identical system parts. Such system parts, such as needles or other knitting tools, must be procured and kept on hand as spare parts or wearing parts so as to be inserted as needed. For the initial setup and for spare parts needs, the system parts are shipped in relatively large numbers. For that purpose, the system parts are packed in paper envelopes, for instance.

Such a system part can be constructed in a single part or multiple parts. For instance, from German Patent Disclosure DE 101 48 196, a needle for loop-forming machines is known that comprises a body and a selective part. The two elements are joined together by material engagement, for instance being glued. The connection, or bond, is just durable enough to hold the two elements together in a way that can be manipulated. As a result, they do not fall apart and can be inserted together into a needle bed very simply. However, the connection is so weak that in operation, it is undone the first time the selective part moves relative to the system part body and thereafter no longer interferes with the function of the needle. These needles, too, are packed in bundles in paper envelopes, for instance.

When maintenance is done on knitting machines or other kinds of loop-forming machines, the knitting tools or other system parts, which are often present in relatively high numbers, must be replaced with new ones.

SUMMARY OF THE INVENTION

The object of the invention is to make it easier to handle a large number of system parts, in particular needles for loop-forming machines, especially for initially equipping machines or equipping them with spare parts.

The above object generally is achieved according to the present invention by a packet or shipping unit that comprises a plurality of elongated, preferably identical system parts, in particular needles for loop-forming machines. These parts usually have two substantially flat sides facing one another and an encompassing circumferential or peripheral face located between the sides. The system parts are located side by side so that the sides of adjacent system parts face one another, and adjacent system parts are joined together by at least one material-engaged connection point that can be undone or broken without damage to the system parts upon insertion of the system parts into a machine bed.

The durability of the material connection, or connection made by material engagement, between the system parts is dimensioned such that the packet will not fall apart when being manipulated simply, for instance being lifted. The weakest connections between a plurality of adjacent system parts withstands the forces typically exerted in manipulation. On the other hand, when the packet is taken apart, all the connections between adjacent system parts must be capable of being separated simply, preferably by hand, without damaging the system parts. The strongest connection between adjacent system parts can therefore be undone by exerting a force that is so slight that it does not cause damage to the system parts in the process of taking apart the packet.

The durability of the connection depends on the one hand on the choice of the connecting material and its adhesive adherence at the connection points and on the other on the size and position of the connection points. The connection point can include either the entire side of the system part, or parts of it, such as the edge, or a cohering region, or a plurality of partial faces distributed over the entire side. The capacity of the connection to bear bending moments or torsion, conversely, can be influenced not only by the adhesive adherence at the connection points and their total surface area but also by their arrangement. Connection points distributed widely over the surface of the system part, for instance at the edge or at individual points, bring about a greater capacity to bear bending or torsion than a narrowly defined area of the same size. An advantageous connection that withstands tensile forces relatively well but can already be undone by a relatively slight bending or torsional moment comprises a single relatively large connection point. This connection point is preferably located at a relatively invulnerable place, for instance in the center of one flat side of the system part.

A material connection between adjacent system parts can be brought about by means of adhesive or paint, for instance. The adhesive or paint is preferably adjusted such that after drying or curing it loses its stickiness and also no longer has any cling factor, so that the cleaved faces that may occur when the connection is undone will not adhere when they come into contact with one another or with other objects, especially the yarn to be processed or the walls of the guide tracks of a loop-forming machine.

Preferably, a paint or adhesive will be selected whose adherence by adhesion to the connection points of the surface of the system part, which is most often of metal, is considerably less than the cohesion within the paint or adhesive. As a result, the connection is mostly undone at one of the connection points when the shipping unit is taken apart, and as a result one of the already-separated system parts is already at least virtually free of paint or adhesive residues, while the mass of paint or adhesive adheres virtually completely to the second system part. A slight adhesion to the connection point, in a further step, also makes it easier to remove the paint or adhesive mass from the second system part, from which the residues can be detached in one piece in the ideal case.

It is possible both to use adhesives or paints that are generally soluble in machine oil, and to use those that are generally insoluble in it. Soluble paints or adhesives have the advantage that residues present on the system parts are removed by the machine oil. Insoluble paints or adhesives have the advantage of not altering the machine oil. However, adhesives or paints can also be used which are soluble in special machine oils while in other machine oils they are insoluble.

The system parts can have two facing, substantially smooth flat sides, which are joined by material engagement to the flat sides of the adjacent system parts. The flat sides are functional faces, which guide the knitting machine needles in the needle track. The knitting machine needles move here with only slight play. Before the insertion of the knitting machine needles; however, the flat sides serve to temporarily join the knitting machine needles into a packet by material engagement. The system parts of a packet are preferably identically oriented and are located side by side in one direction in space, which is perpendicular to the flat sides. The flat sides of adjacent system parts face one another and are preferably joined together at least one connection point on the facing flat sides by the connecting means.

The flat sides of the system parts can be separated solely by a connecting means located between them, and they are kept slightly spaced apart by it and can touch one another in some regions. The material connection between two system parts can, however, also be established via a spacer, which is located between the facing flat sides of two adjacent system parts and can be joined to the adjacent system parts in the same way, described above, as system parts are joined to one another. The spacer preferably comprises plastic, for instance in the form of a small plate, but can also comprise some other material, such as metal. Its size is preferably dimensioned such that the spacing of adjacent system parts that results from its incorporation is equivalent to a predetermined spacing, which for instance matches the spacing of the needle cylinder of a knitting machine. In this way, inserting many needles into the needle tracks can be simplified and speeded up.

A spacer located between adjacent system parts can also further simplify the process of removing the adhesive residues. For that purpose, the spacer is preferably of plastic, and an adhesive or paint can be selected which, for instance by starting to dissolve the surface of the spacer, enters in a considerably firmer bond with it than with the usually metal surface of the system part. If the bond between two adjacent system parts is undone, this happens at the weakest point. This is then the bond with the surface of one of the system parts, because the adhesion there is weaker than at the surface of the spacer, or weaker than the cohesion within the adhesive mass. In a further step, the spacer is separated from the second system part, and once again the separation takes place along the surface of the system part. As a result, the shipping unit is taken apart into system parts to which no adhesive or paint adheres to either side, and spacers to which by far the greatest proportion or the entire amount of the adhesive or paint of the applicable connection point adheres to both sides. In this way, the system parts are at least largely adhesive-free solely by the removal of the relatively easily handled spacers, without requiring that adhesive residues be removed from the system parts in a more-complicated work step.

To facilitate the operation of separating the shipping unit and detaching the spacers, the spacers may have a grip portion that protrudes from the interstice between adjacent system parts and serves the user as an engagement point for manual intervention or for a tool, such as tongs or tweezers. The "grip" in this sense need not be only a specially shaped portion of the spacer for that purpose. It is also possible and advantageous to use a block-shaped small plastic plate, for instance, which is located between the adjacent system parts in such a way that part of it protrudes out of the interstice between the two system parts and provides the engagement point for tools that is wanted so that the small plate can be removed.

A material bond between a plurality of system parts can also be established by means of common connecting elements that are joined materially to a plurality of system parts. Preferably, a single common connecting element is joined to all the system parts of the shipping unit. Each system part, preferably on a circumferential face extending all the way around between the flat sides, can have a connection point which is joined materially to the common connecting element. The common connecting element can be a preferably self-adhesive foil which is joined to a plurality of system parts. It is also possible for spacers to be located between adjacent system parts and for both the system parts and the spacers to be joined to the common connecting element, without the system parts and spacers having to be joined directly to one another.

Advantageous embodiments of the invention will become apparent from the drawings, the description, and the dependent claims.

BRIEF DESCRIPTION OF THE DRAWINGS

In the drawings, exemplary embodiments of the invention are shown. Shown are.

DETAILED DESCRIPTION OF THE DRAWINGS

Figures 1, 2, 3:
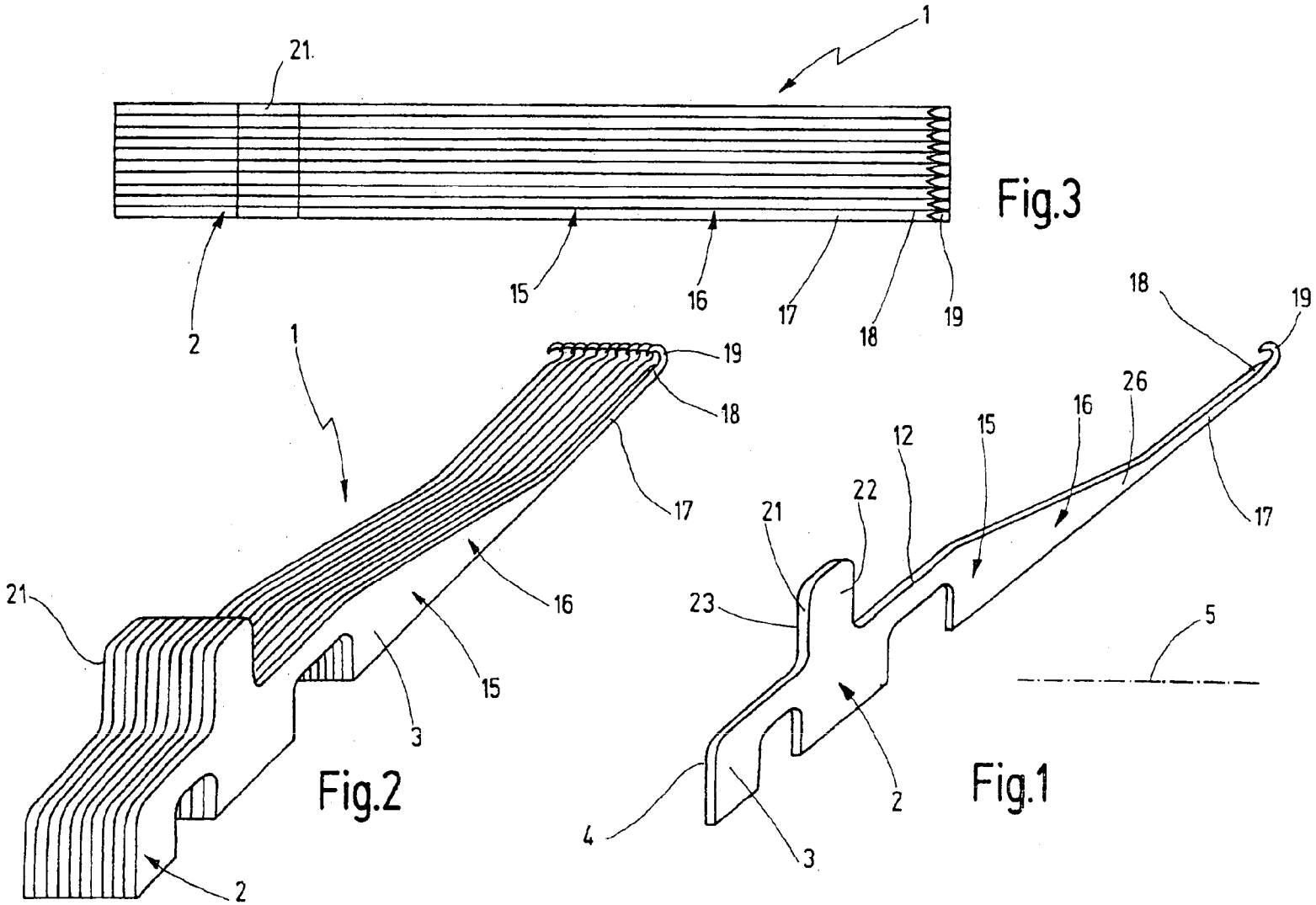
FIG. 1, a perspective view of a knitting machine needle.
FIG. 2, a perspective view of a shipping unit made up of a plurality of knitting machine needles of the type shown in FIG. 1, which are glued together with paint to make a packet.
FIG. 3, a plan view of the shipping unit of FIG. 2.

In FIG. 1, a system part is shown, taking as an example a needle 2 for knitting machines. Each needle has a flat needle body 15 with a guide part 16 and a shank 17, on the free end 18 of which a hook 19 is embodied. No parts protrude past the flat sides of the guide part 16, which form the sides 3, 4. A butt 21 is embodied on the guide part 16, and its flat sides 22, 23 are located in the same planes as the sides 3, 4.

In FIGS. 2 and 3, a shipping unit 1 made up of a plurality of identical needles 2 is shown. All the needles 2 are located in one row side by side and are oriented identically; the sides 3, 4 of adjacent needles 2 point toward one another. The needles 2 are located relative to one another essentially in one direction 5 in space, perpendicular to the sides 3, 4 of the needles 2. The adjacent needles 2 are glued together (FIG. 4) at two connection points 6 each on the sides 3, 4 of each needle, at which a fixing paint 27 is located as connecting material 7. The needles 2 are separated from one another by only a thin film of the fixing paint 27 at the connection point 6 and by an air gap of similar width at the other points. The needles 2 may also touch one another at some points.

To make it possible to insert the needles 2 of one shipping unit 1 in a knitting machine, they must be separated from one another. To that end, the bond between each two adjacent needles 2 of the shipping unit 1 is loaded by manual exertion of force for tension, bending or torsion such that the needles 2 come apart from one another. In the process of separation, the parts of the shipping unit to be separated can be taken into the hand or grasped with a fingernail or a tool, such as tongs or tweezers. It is also possible first to fix the shipping unit in a holding device, such as a vise, so that the needles 2 can subsequently be removed individually. The individual needles are inserted into the guide tracks 24 of the knitting machine.

When the bonds are undone, a substantially pure tensile stress arises by exertion of a tensile force perpendicular to the planes defined by the sides 3, 4, in the region of the connection points 6. A bending stress on the connection points 6 is attained by exerting a moment between two adjacent needles 2 about an axis of rotation that is located essentially in the plane of the glued-together sides 3, 4 of the two needles 2. The bending moment causes some of the connection points 6 between the two needles to be loaded with pressure and another group of them to be loaded with tension. At the points of the connection points 6 loaded for tension, disconnection of the bond occurs as soon as the forces exerted there are high enough. By leverage, the incident forces can be amplified when the connection point 6 and the engagement point for the force exerted to separate the bond fall apart. A connection point located only in the region of the butt 21 of the needle 2 can be undone by a relatively slight force, for instance, which is introduced in the region of the more-remote end 26 of the guide part 16 and pulls two adjacent needles 2 apart in a direction in space perpendicular to the sides 3, 4. The connection point 6 and the engagement points of the forces exerted to separate the bonds are preferably located on the wider, relatively invulnerable guide part 16 of the needle 2, to prevent damage to the needle from the forces exerted.

Separating the bonds can advantageously also be done by torsion. In that case, a moment whose axis of rotation extends essentially in the direction 5 in space perpendicular to the sides 3, 4 is exerted between two adjacent needles 2. Because of their flat shape, the needles can withstand substantially greater moments about an axis of rotation in the direction 5 in space perpendicular to the sides 3, 4 than about an axis of rotation in a direction in space along the sides 3, 4. The connection points 6 are stressed for shearing, and the load increases with increasing distance from the axis of rotation and suffices to undo the bond. The forces can advantageously be amplified by leverage, because of the fact that the connection point 6 is located relatively compactly in a relatively resistant portion of the needle, such as the butt 21, and the forces required to generate the torsional moment are introduced relatively far apart, for instance at the more-remote end 26 of the guide part 16.

Figure 4:
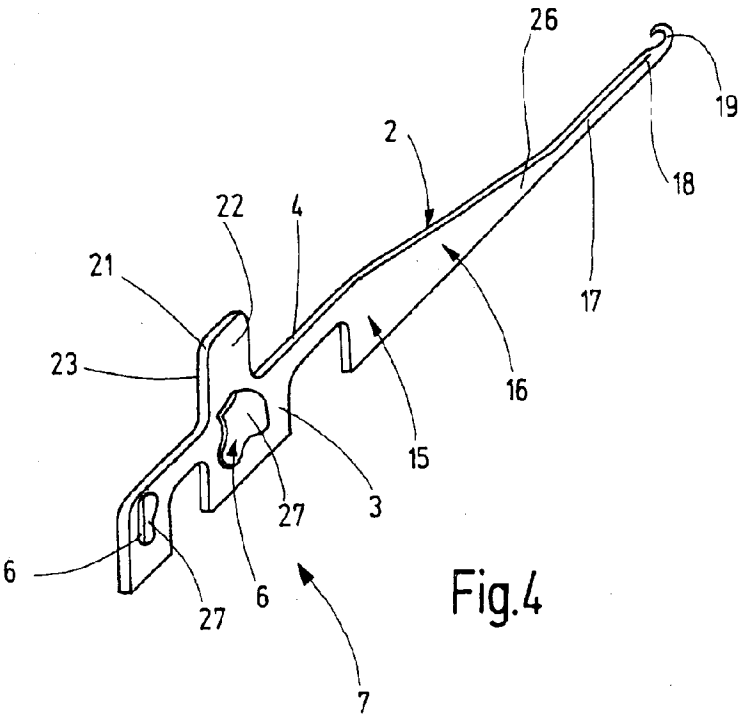
FIG. 4, a knitting machine needle that has been separated from a shipping unit of the type shown in FIG. 2.

A needle 2 that has been separated from a shipping unit 1 of FIG. 2 is shown in FIG. 4. Residues of the fixing paint 27 can still be found at the connection points 6 on the side 3.

Figure 7:
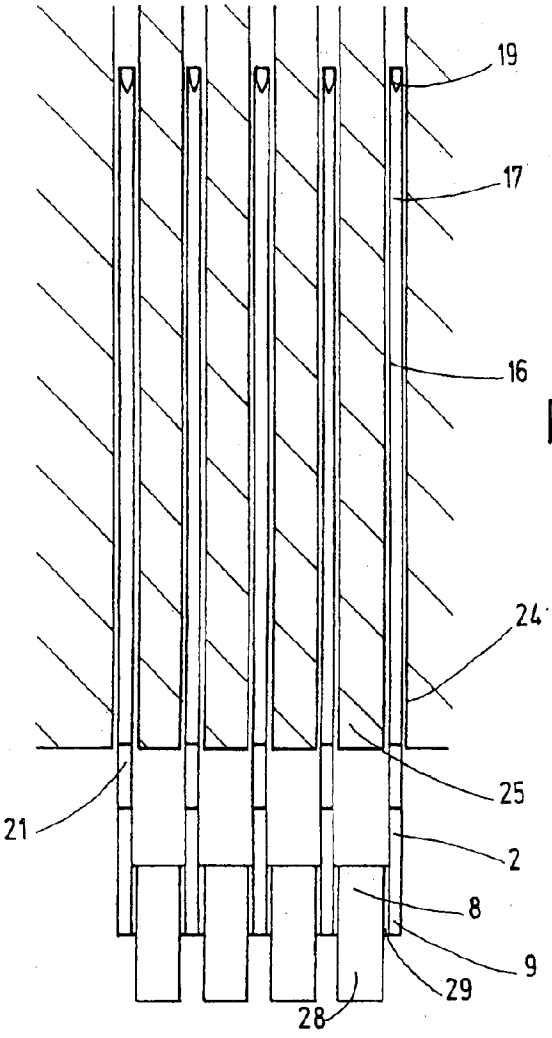
FIG. 7, a section in the plane of the guide tracks through a shipping unit of the type shown in FIG. 5, whose needles are inserted with their guide parts into the guide tracks of a knitting machine.
Figure 6:
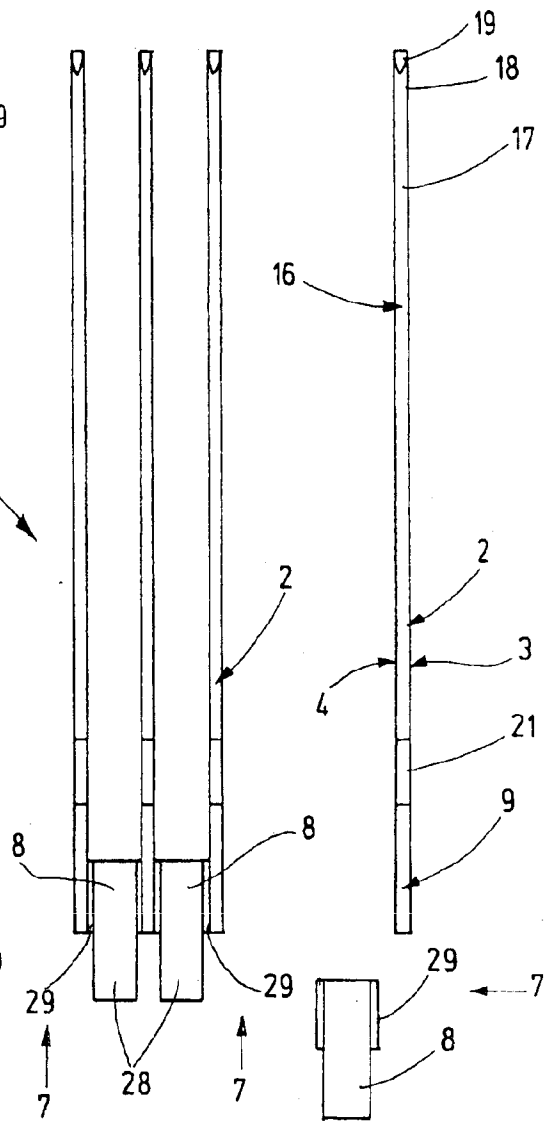
FIG. 6, a plan view of the arrangement of FIG. 5.
Figure 5:
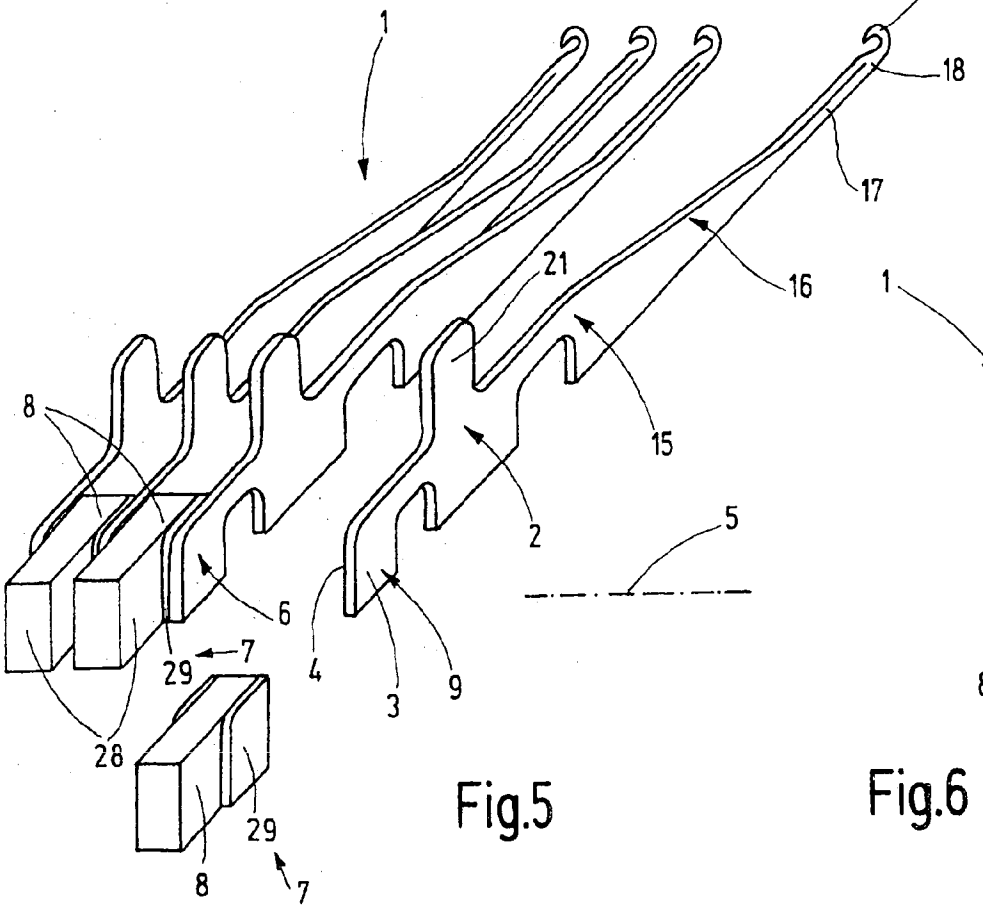
FIG. 5, a perspective view of a second embodiment of a shipping unit made up of a plurality of knitting machine needles of the type shown in FIG. 1.

In FIGS. 5 through 7, a shipping unit 1 is shown which comprises a plurality of identical needles 2, of the type shown in FIG. 1, for loop-forming machines. The needles 2 are located in a row and are oriented identically, and the sides 3, 4 of adjacent needles 2 face one another. The needles 2 are located relative to one another essentially in a direction 5 in space that is perpendicular to the sides 3, 4 of the needles 2. The sides 3, 4 facing one another of adjacent needles 2 have a spacing which is dimensioned such that the spacing of the needles 2 matches a predetermined spacing in a machine for which the needles 2 are intended to be used. To maintain this spacing, one small plastic plate 8 is located as a spacer between each two adjacent needles 2. The adjacent needles 2 are joined to the small plastic plate 8 and as a result materially to one another by means of an adhesive 29 serving as the connecting material. The connection point 6 is located in the rear region 9 of each needle 2, to make it possible to insert all the needles 2 jointly, that is, in common, into the guide tracks 24 of a knitting machine. The small plastic plates 8 have a portion 28 which protrudes to the rear past the guide part 16 of the needles 2 and thus offers an engagement point, for instance for tools, with the aid of which the small plastic plates 8 can be separated from the needles 2 simply by torsion or bending. It is also conceivable for the portion 28 of the small plastic plates 8 to protrude past the guide part 16 in the direction of the needle butt. As a result, it is possible to remove the small plastic plates from above the needle 2 by means of a tool.

FIG. 7 shows a plurality of needles 2 of a shipping unit 1 which are still joined together and which when inserted into the knitting machine are thrust simultaneously, with the shank 17 leading, into adjacent guide tracks 24 intended for receiving the needles and have already been partly received in the guide tracks 24. As soon as the spacers 8 located between the needles 2, in the course of further advancement, abut against the ribs 25 located between the guide tracks 24, the small plastic plates 8 are removed, for instance by placing tongs against the portion 28 protruding past the region 9 of the needles 2, and the small plate is disconnected from the needles 2 by exerting a moment about an axis of rotation in the direction 5 in space perpendicular to the sides 3, 4 of the needles and is lifted out of the interstice between the needles. Next, the individual needles 2 are thrust all the way into the guide tracks 24.

Figure 9:
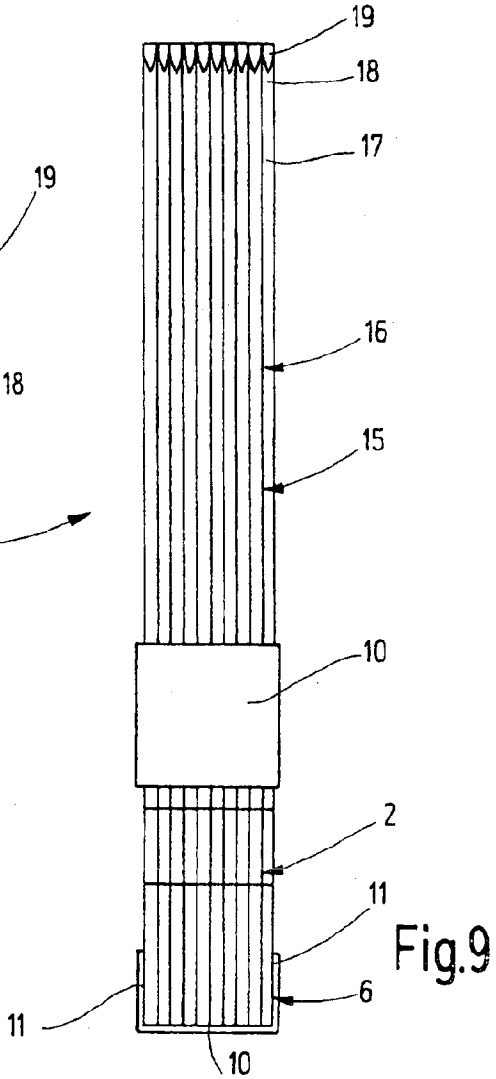
FIG. 9, a plan view of the shipping unit of FIG. 8.
Figure 8:
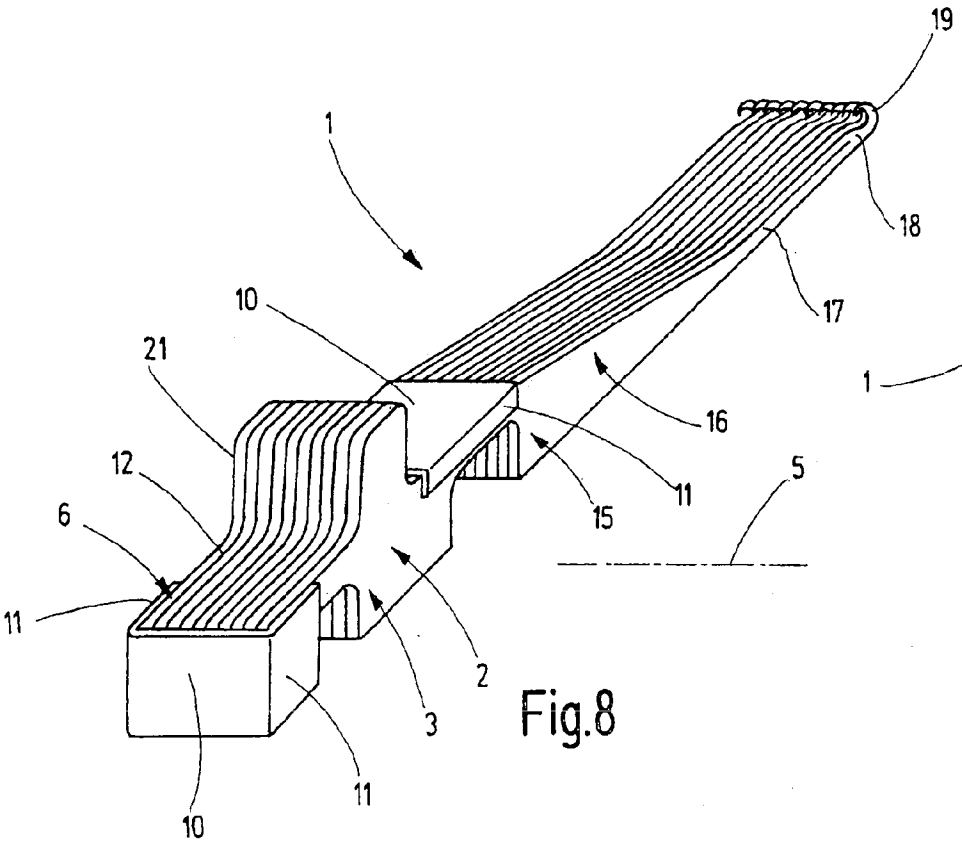
FIG. 8, a shipping unit made up of a plurality of knitting machine needles of FIG. 1 which are held together with a self-adhesive foil.

In FIGS. 8 and 9, a shipping unit 1 is shown which comprises a plurality of identical needles 2 of the type shown in FIG. 1 for loop-forming machines. The needles 2 are located in a row and are oriented identically, and the sides 3, 4 of adjacent needles 2 face one another. The needles 2 are located relative to one another essentially along a direction 5 in space that is perpendicular to the sides 3, 4 of the needles 2. The facing sides 3, 4 of the needles 2 touch, without being glued directly by means of a connecting material 7. All the needles 2 are joined together by two preferably self-adhesive foils 10, which serve as common connecting elements and which touch each needle 2 on a circumferential face 12 located between the sides 3, 4. Preferably, the connection points 6 for all the needles 2 are located identically, and the first and last needles 2 of the shipping unit each have one additional connection point 6, on the side 3, 4 facing away from the other needles 2, that is created by folding over a protruding end 11 of the foils 10. Each foil 10 is located in a strip essentially perpendicular to the sides 3, 4 of the needles 2 and touches each needle 2 at the connection points 6.

The shipping unit 1 can be taken apart by pulling the foils 10 off the needles 2. In order to separate only some of the needles 2 from the shipping unit 1 and keep the others on hand as a cohering unit, the foils 10 are undone in only one portion, so that only the needles 2 intended to be removed are exposed and subsequently taken out. The other needles 2 are advantageously held together by re-securing the foils 10; the ends 11 of the foils 10 that protrude farther because of the removal of some of the needles 2 may optionally be cut off, or folded over onto the sides 3, 4 of the outer needles 2, facing away from the other needles 2, of the part of the shipping unit 1 that still exists.

LIST OF REFERENCE NUMERALS:

1 Shipping unit
2 Needle

3, 4 Sides
5 Direction in space
6 Connection point
7 Connecting material
8 Small plastic plate
9 Rear region
10 Foil
11 Protruding end
12 Circumferential face
15 Needle body
16 Guide part
17 Shank
18 Free end
19 Hook
21 Butt
22, 23 Flat sides
24 Guide tracks
25 Rib
26 More-remote end
27 Fixing paint
28 Protruding end
29 Adhesive

What is claimed is:

1. A shipping unit of elongated system parts for loop-forming machines, wherein:

each system part has two facing sides and one encompassing circumferential face located between the sides;

the system parts are located side by side, and the sides of adjacent system parts face one another; and adjacent system parts are joined together by at least one material-engaged connection point, which is adapted to be undone upon insertion of the system parts into a machine bed.

2. The shipping unit of claim 1, wherein all the system parts of the shipping unit are identical to one another.

3. The shipping unit of claim 1, wherein the sides of the system parts have a plurality of connection points that are not joined together.

4. The shipping unit of claim 1, wherein for embodying the material connection, a connecting material is provided whose strength and adhesive strength are dimensioned such that the system parts can be separated by hand without damaging them.

5. The shipping unit of claim 4, wherein adjacent system parts are joined directly to one another by the connecting material.

6. The shipping unit of claim 4, wherein a spacer is located between each two adjacent system parts and is joined to each of the two adjacent system parts by the connecting material.

7. The shipping unit of claim 4, wherein the adhesive adherence of the connecting material to the connection point is less than the cohesive adherence of the connecting material.

8. The shipping unit of claim 6, wherein the adhesive adherence of the connecting material at the surface of the spacer is greater than the adhesive adherence of the connecting material at the connection point and less than the cohesive adherence of the connecting material.

9. The shipping unit of claim 6, wherein the spacer is dimensioned such that the spacing of adjacent system parts matches a predetermined spacing.

10. The shipping unit of claim 4 wherein the connecting material is soluble in machine oil.

11. The shipping unit of claim 1, characterized in that all the system parts are joined to one common connecting element.

12. The shipping unit of claim 11, wherein the common connecting element is a foil.

13. The shipping unit of claim 12, wherein the foil is self-adhesive.

14. The shipping unit of claim 8 wherein the spacer is dimensioned such that the spacing of adjacent system parts matches a predetermined spacing.

15. The shipping unit of claim 1, wherein system parts are needles.

16. The shipping unit of claim 6, wherein: the system parts are needles; and, the spacers are further dimensioned such that the spacers extend only partially between adjacent needles and protrude beyond a rear end of the needles.

17. A method of forming and using a shipping unit of elongated system parts for loop-forming machines, comprising:

providing a plurality of system parts, with each system part having two facing sides and an encompassing circumferential face located between the sides;

locating the plurality of system parts side by side, with the sides of adjacent system parts facing one another;

joining adjacent system parts together by at least one material-engaged connection point to form the shipping unit;

transporting the unit to a machine for installation and use of the system parts; and, breaking the connection at each connection point upon insertion of the system parts into the machine.

18. The method of claim 17, wherein all of the system parts of the shipping unit are identical to one another, and the step of locating includes identically orienting all of the system parts.

19. The method of claim 17, wherein the step of joining includes forming the material connection using a connecting material whose strength and adhesive strength are dimensioned such that the system parts are separable by hand without damaging them.

20. The method of claim 17, wherein the step of joining includes joining adjacent system parts directly to one another by the connecting material.

21. The method of claim 17, wherein the step of joining includes locating a spacer between each two adjacent system parts, and joining each of the two adjacent system parts to the spacer by the connecting material.

22. The method of claim 21, further including, dimensioning the spacers such that the spacing of adjacent system parts matches a predetermined spacing.

23. The method of claim 22, wherein the system parts are needles and the step of dimensioning further includes dimensioning the spacers such that the spacers extend only partially between adjacent needles and protrude beyond a base end of the needles.

24. The method of claim 17, wherein system parts are needles.

* * * * *